US010722099B2

(12) United States Patent
Anim-Mensah et al.

(10) Patent No.: US 10,722,099 B2
(45) **Date of Patent: *Jul. 28, 2020**

(54) WAREWASHER WITH HEAT RECOVERY SYSTEM

(71) Applicant: ILLINOIS TOOL WORKS INC., Glenview, IL (US)

(72) Inventors: Alexander R. Anim-Mensah, Miamisburg, OH (US); Nigel G. Mills, Kettering, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/238,655

(22) Filed: Jan. 3, 2019

(65) Prior Publication Data

US 2019/0133410 A1 May 9, 2019

Related U.S. Application Data

(63) Continuation of application No. 15/177,997, filed on Jun. 9, 2016, now Pat. No. 10,178,940.
(Continued)

(51) Int. Cl.
*A47L 15/00* (2006.01)
*A47L 15/24* (2006.01)
(Continued)

(52) U.S. Cl.
CPC ..... *A47L 15/4285* (2013.01); *A47L 15/0015* (2013.01); *A47L 15/0047* (2013.01);
(Continued)

(58) Field of Classification Search
CPC ..... A47L 15/0015; A47L 15/0047; A47L 15/0078; A47L 15/241; A47L 15/4214;
(Continued)

(56) References Cited

U.S. PATENT DOCUMENTS 3,315,293 A 4/1967 Warner et al.
3,598,131 A 8/1971 Weihc, Jr.
(Continued)

FOREIGN PATENT DOCUMENTS

CN 102032698 A 4/2011
CN 102187165 A 9/2011
(Continued)

OTHER PUBLICATIONS

Tsukada et al., "JP2008267616A English Machine Translation.pdf", Nov. 6, 2008—Machine translation from Espacenet.com.*
(Continued)

*Primary Examiner* — Levon J Shahinian
(74) *Attorney, Agent, or Firm* — Thompson Hine LLP

(57) ABSTRACT

A warewash machine includes a chamber for receiving wares, the chamber having at least one wash zone. A refrigerant medium circuit includes a first heat exchanger arranged to deliver refrigerant medium heat to a first fluid and a second heat exchanger arranged to provide a heat exchange relationship between the refrigerant medium and a second fluid, the first heat exchanger located upstream of the second heat exchanger in the refrigerant medium circuit. A bypass arrangement for causing at least some refrigerant medium to selectively bypass at least one of the first condenser or the second condenser based upon subcooled refrigerant medium condition.

20 Claims, 2 Drawing Sheets

Related U.S. Application Data

(60) Provisional application No. 62/199,521, filed on Jul. 31, 2015.

(51) Int. Cl.

| | |
|---|---|
| ***A47L 15/42*** | (2006.01) |
| ***A47L 15/46*** | (2006.01) |
| ***F25B 39/00*** | (2006.01) |
| ***F25B 39/04*** | (2006.01) |

(52) U.S. Cl.

CPC ..... *A47L 15/241* (2013.01); *A47L 15/4214* (2013.01); *A47L 15/4291* (2013.01); *A47L 15/46* (2013.01); *F25B 39/00* (2013.01); *A47L 15/0078* (2013.01); *A47L 2401/34* (2013.01); *F25B 39/04* (2013.01)

(58) Field of Classification Search

CPC .. A47L 15/4285; A47L 15/4291; A47L 15/46; A47L 2401/34; F25B 39/00; F25B 39/04

USPC ..... 134/56 D, 57 D, 58 D, 105, 107, 108

See application file for complete search history.

(56) References Cited

U.S. PATENT DOCUMENTS

| | | | |
|---|---|---|---|
| 3,789,860 | A | 2/1974 | Katterheinrich et al. |
| 3,946,802 | A | 3/1976 | Christenson |
| 3,965,494 | A | 6/1976 | Baker |
| 3,986,345 | A | 10/1976 | Pilz et al. |
| 4,098,616 | A | 7/1978 | Dorius et al. |
| 4,125,148 | A | 11/1978 | Molitor |
| 4,129,179 | A | 12/1978 | Molitor |
| 4,219,044 | A | 8/1980 | Wilson |
| 4,326,551 | A | 4/1982 | Voorhees |
| 4,519,440 | A | 5/1985 | Weitman |
| 4,529,032 | A | 7/1985 | Molitor |
| 4,531,572 | A | 7/1985 | Molitor |
| 5,331,984 | A | 7/1994 | Isagawa |
| 5,642,742 | A | 7/1997 | Noren et al. |
| 5,660,193 | A | 8/1997 | Archer et al. |
| 5,794,634 | A | 8/1998 | Noren et al. |
| 5,816,273 | A | 10/1998 | Milocco et al. |
| 5,829,459 | A | 11/1998 | Milocco et al. |
| 5,884,694 | A | 3/1999 | Tanenbaum |
| 5,934,078 | A | 8/1999 | Lawton, Jr. et al. |
| 6,072,153 | A | 6/2000 | Aoki et al. |
| 6,357,245 | B1 | 3/2002 | Weng et al. |
| 6,591,846 | B1 | 7/2003 | Ferguson et al. |
| 7,103,992 | B2 | 9/2006 | Deden et al. |
| RE40,123 | E | 3/2008 | Johansen et al. |
| 8,157,924 | B2 | 4/2012 | Warner et al. |
| 8,498,523 | B2 | 7/2013 | Deivasigamani et al. |
| 8,663,395 | B2 | 3/2014 | Warner et al. |
| 8,679,261 | B2 | 3/2014 | Brunswick et al. |
| 10,178,940 | B2 * | 1/2019 | Anim-Mensah .... A47L 15/0015 |
| 2003/0005731 | A1 | 1/2003 | Montgomery |
| 2003/0178498 | A1 | 9/2003 | Saitoh et al. |
| 2004/0123880 | A1 | 7/2004 | Chiles et al. |
| 2004/0187339 | A1 | 9/2004 | Duden et al. |
| 2004/0200905 | A1 | 10/2004 | Saitoh et al. |
| 2004/0227003 | A1 | 11/2004 | Alvarez et al. |
| 2004/0261820 | A1 | 12/2004 | Monsrud et al. |
| 2005/0167516 | A1 | 8/2005 | Saitoh et al. |
| 2006/0073430 | A1 | 4/2006 | Chiles et al. |
| 2006/0090798 | A1 | 5/2006 | Beagan et al. |
| 2007/0089230 | A1 | 4/2007 | Hendricks |
| 2007/0143914 | A1 | 6/2007 | Shiral et al. |
| 2007/0170270 | A1 | 7/2007 | Jelinek et al. |
| 2007/0210118 | A1 | 9/2007 | Gadini |
| 2008/0000616 | A1 | 1/2008 | Nobile |
| 2008/0077281 | A1 | 3/2008 | Gaus |
| 2008/0115807 | A1 | 5/2008 | Gaus |
| 2009/0120465 | A1 | 5/2009 | Peukert et al. |
| 2009/0151750 | A1 | 6/2009 | Ecker et al. |
| 2009/0277482 | A1 | 11/2009 | Kim et al. |
| 2010/0024844 | A1 | 2/2010 | Brunswick et al. |
| 2011/0048342 | A1 | 3/2011 | Vroom |
| 2014/0007767 | A1 * | 1/2014 | Grunewald ..... A47L 15/481 95/126 |

FOREIGN PATENT DOCUMENTS

| | | | |
|---|---|---|---|
| CN | 102727149 | A | 10/2012 |
| CN | 203252618 | U | 10/2013 |
| CN | 103519764 | A | 1/2014 |
| CN | 103836847 | A | 6/2014 |
| CN | 104245376 | A | 12/2014 |
| CN | 204313358 | U | 5/2015 |
| CN | 108024687 | A | 5/2018 |
| EP | 2746454 | | 6/2014 |
| JP | H10115457 | A | 5/1998 |
| JP | 2008267616 | A * | 11/2008 |
| WO | WO 2015/080928 | | 6/2015 |

OTHER PUBLICATIONS

PCT, International Search Report and Written Opinion, International Application No. PCT/US2016/043063; dated Oct. 26, 2016, 11 pages.

Xu Ming, "A Design of a Fan Drying Device for Dishwasher", Electrical Appliances, Issue No. 12, Dec. 25, 2012, Full text, 2 pages.

* cited by examiner

WAREWASHER WITH HEAT RECOVERY SYSTEM

TECHNICAL FIELD

This application relates generally to warewashers such as those used in commercial applications such as cafeterias and restaurants and, more particularly, to a heat recovery system that adapts to operating conditions of the warewasher.

BACKGROUND

Commercial warewashers commonly include a housing area which defines washing and rinsing zones for dishes, pots, pans and other wares. Heat recovery systems have been used to recover heat from the machine that would ordinarily be lost to the machine exhaust.

Waste heat recovery systems such as a heat pump or refrigeration system uses evaporator(s), compressor(s) and condenser(s) such that the operation involves thermal fluids (including refrigerant) for recovering waste energy and re-using captured energy at areas of interest. The systems require the thermal fluid to operate within a specified envelope to prevent system shut down from high or low pressure, hence, the need for effective controls.

It would be desirable to provide a heat recovery system that adapts to machine operating condition in order to make more effective use of heat recovery. It would also be desirable to provide a heat recovery system that is able to more effectively maintain desired subcooled condition of refrigerant medium.

SUMMARY

In one aspect, a warewash machine includes a chamber for receiving wares, the chamber having at least one wash zone. A refrigerant medium circuit includes a first heat exchanger arranged to deliver refrigerant medium heat to a first fluid and a second heat exchanger arranged to deliver refrigerant medium heat to a second fluid, the first heat exchanger located upstream of the second heat exchanger in the refrigerant medium circuit. A bypass arrangement for causing at least some refrigerant medium to selectively bypass at least one of the first condenser or the second condenser based upon subcooled refrigerant medium condition.

In one implementation of the foregoing aspect, the bypass arrangement includes a valve upstream of the first condenser, and a bypass path from the valve around the first heat exchanger to a downstream side of the first heat exchanger.

In one variation of the foregoing implementation, the first heat exchanger is a condenser in the refrigerant medium circuit, the second heat exchanger is a condenser in the refrigerant medium circuit and the bypass arrangement further includes a refrigerant medium temperature sensor and a refrigerant medium pressure sensor downstream of all condensers in the refrigerant medium circuit and upstream of a thermal expansion valve in the refrigerant medium circuit.

In one example of the foregoing variation, a controller is connected with the refrigerant medium temperature sensor and the refrigerant medium pressure sensor, the controller configured to determine a subcooled condition of the refrigerant medium and to control the valve based upon the subcooled condition.

In one instance of the foregoing variation, the controller is configured to switch the valve to flow refrigerant medium along the bypass path when the subcooled condition is above a set operating range.

In one case of the foregoing instance, the controller is configured such that, if the subcooled condition remains above the set threshold for a predetermined time period after the valve is switched to flow refrigerant medium along the bypass path, the controller activates a heating element that is positioned to heat the second fluid.

In another aspect, a warewash machine includes a chamber for receiving wares, the chamber having at least one wash zone. A refrigerant medium circuit includes a first condenser and a second condenser, the first condenser located upstream of the second condenser in the refrigerant medium circuit. The refrigerant medium circuit including a first flow path through the first condenser and a second flow path in bypass of the first condenser, and a valve for selectively controlling whether at least some refrigerant medium flows along the first flow path or the second flow path based upon subcooled refrigerant medium condition.

In another aspect, a method is provided for controlling refrigerant flow in a refrigerant circuit of a warewash machine that includes a chamber for receiving wares, the chamber having at least one wash zone, the refrigerant circuit including a first condenser and a second condenser, the first condenser located upstream of the second condenser in the refrigerant circuit. The method involves: flowing refrigerant medium through both the first condenser and the second condenser; and identifying an out of range condition of subcooled refrigerant medium in the refrigerant medium circuit and thereafter causing at least some refrigerant medium to flow in bypass around at least one of the first condenser or the second condenser.

In another aspect, a method is provided for controlling a refrigerant medium circuit of a warewash machine, where the refrigerant medium circuit includes at least a first condenser and a second condenser, at least one of the condensers in heat exchange relationship with incoming water to the machine. The method involves: flowing refrigerant medium through both the first condenser and the second condenser; if a first out of range condition of subcooled refrigerant medium is identified, causing at least some refrigerant medium to flow in bypass around at least one of the first condenser or the second condenser.

The details of one or more embodiments are set forth in the accompanying drawings and the description below. Other features, objects, and advantages will be apparent from the description and drawings, and from the claims.

DETAILED DESCRIPTION

Figure 1:
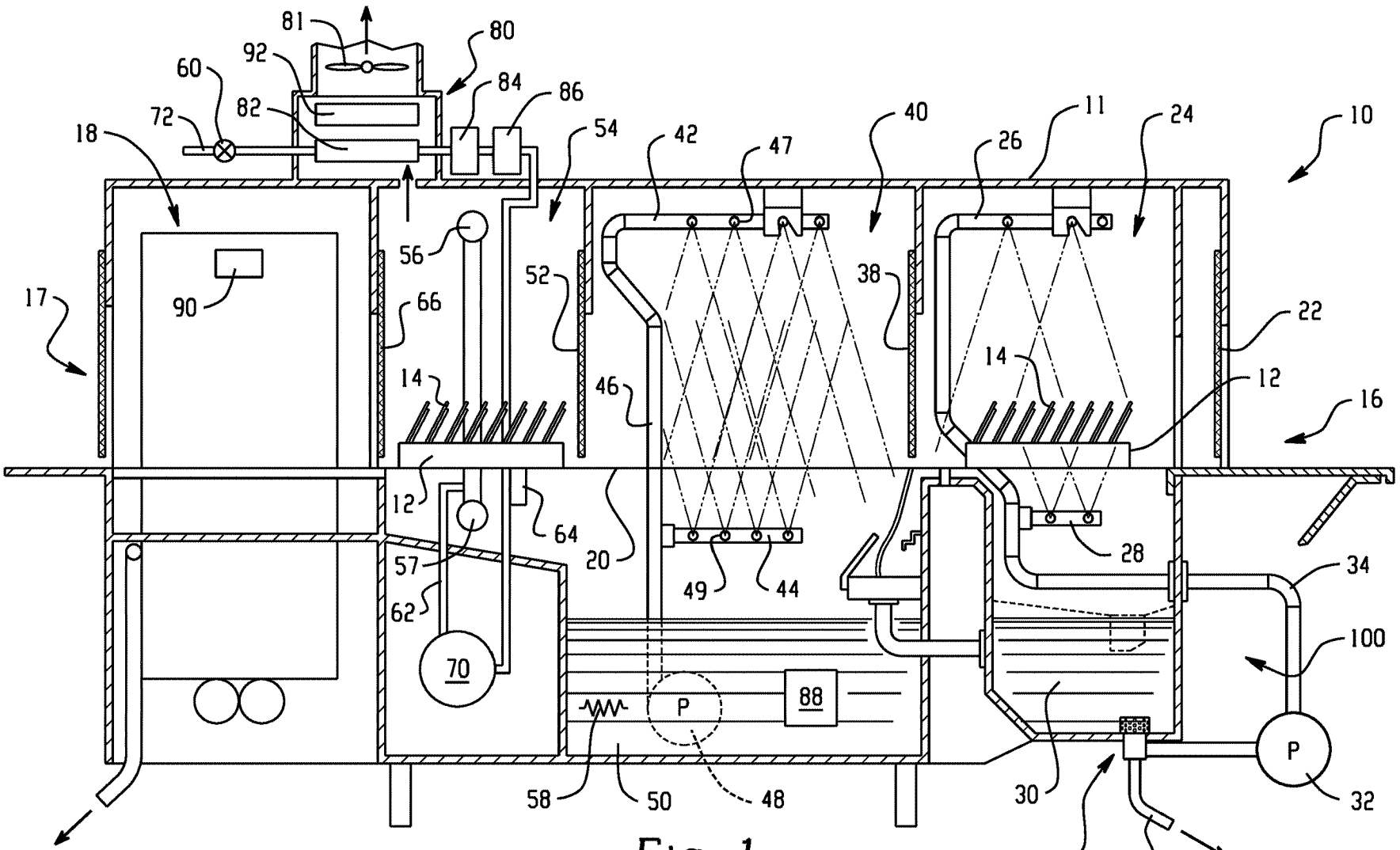
FIG. 1 is a schematic side elevation of one embodiment of a warewasher.

Referring to FIG. 1, an exemplary conveyor-type warewash machine, generally designated 10, is shown. Warewash machine 10 includes a housing 11 that can receive racks 12 of soiled wares 14 from an input side 16. The wares are moved through tunnel-like chambers from the input side toward a blower dryer unit 18 at an opposite exit end 17 of the warewash system by a suitable conveyor mechanism 20.

Either continuously or intermittently moving conveyor mechanisms or combinations thereof may be used, depending, for example, on the style, model and size of the warewash system 10. Flight-type conveyors in which racks are not used are also possible. In the illustrated example, the racks 12 of soiled wares 14 enter the warewash system 10 through a flexible curtain 22 into a pre-wash chamber or zone 24 where sprays of liquid from upper and lower pre-wash manifolds 26 and 28 above and below the racks, respectively, function to flush heavier soil from the wares. The liquid for this purpose comes from a tank 30 and is delivered to the manifolds via a pump 32 and supply conduit 34. A drain structure 36 provides a single location where liquid is pumped from the tank 30 using the pump 32. Via the same drain structure, liquid can also be drained from the tank and out of the machine via drain path 37, for example, for a tank cleaning operation.

The racks proceed to a next curtain 38 into a main wash chamber or zone 40, where the wares are subject to sprays of cleansing wash liquid (e.g., typically water with detergent) from upper and lower wash manifolds 42 and 44 with spray nozzles 47 and 49, respectively, these sprays being supplied through a supply conduit 46 by a pump 48, which draws from a main tank 50. A heater 58, such as an electrical immersion heater provided with suitable thermostatic controls (not shown), maintains the temperature of the cleansing liquid in the tank 50 at a suitable level. Not shown, but which may be included, is a device for adding a cleansing detergent to the liquid in tank 50. During normal operation, pumps 32 and 48 are continuously driven, usually by separate motors, once the warewash system 10 is started for a period of time.

The warewash system 10 may optionally include a power rinse (also known as post-wash) chamber or zone (not shown) that is substantially identical to main wash chamber 40. In such an instance, racks of wares proceed from the wash chamber 40 into the power rinse chamber, within which heated rinse water is sprayed onto the wares from upper and lower manifolds.

The racks 12 of wares 14 exit the main wash chamber 40 through a curtain 52 into a final rinse chamber or zone 54. The final rinse chamber 54 is provided with upper and lower spray heads 56, 57 that are supplied with a flow of fresh hot water via pipe 62 running from a hot water booster 70 under the control of a solenoid valve 60 (or alternatively any other suitable valve capable of automatic control). A rack detector 64 may be actuated when a rack 12 of wares 14 is positioned in the final rinse chamber 54 and through suitable electrical controls (e.g., the controller mentioned below), the detector causes actuation of the solenoid valve 60 to open and admit the hot rinse water to the spray heads 56, 57. The water then drains from the wares and is directed into the tank 50 by gravity flow. The rinsed rack 12 of wares 14 then exits the final rinse chamber 54 through curtain 66, moving into dryer unit 18, before exiting the outlet end 17 of the machine.

An exhaust system 80 for pulling hot moist air from the machine (e.g., via operation of a blower 81) may be provided. As shown, a cold water input 72 line may run through a waste heat recovery unit 82 (e.g., a fin-and-tube heat exchanger through which the incoming water flows, though other variations are possible) to recover heat from the exhaust air flowing across and/or through the unit 82. The water line or flow path 72 then runs through one or more condensers 84 and 86 (e.g., in the form of plate heat exchangers or shell-and-tube heat exchangers, though other variations are possible), before delivering the water to the booster 70 for final heating. A condenser 88 may be located in the wash tank and a condenser 90 may be located in the blower dryer unit 18. A second waste heat recovery unit 92 may also be provided.

Figure 2:
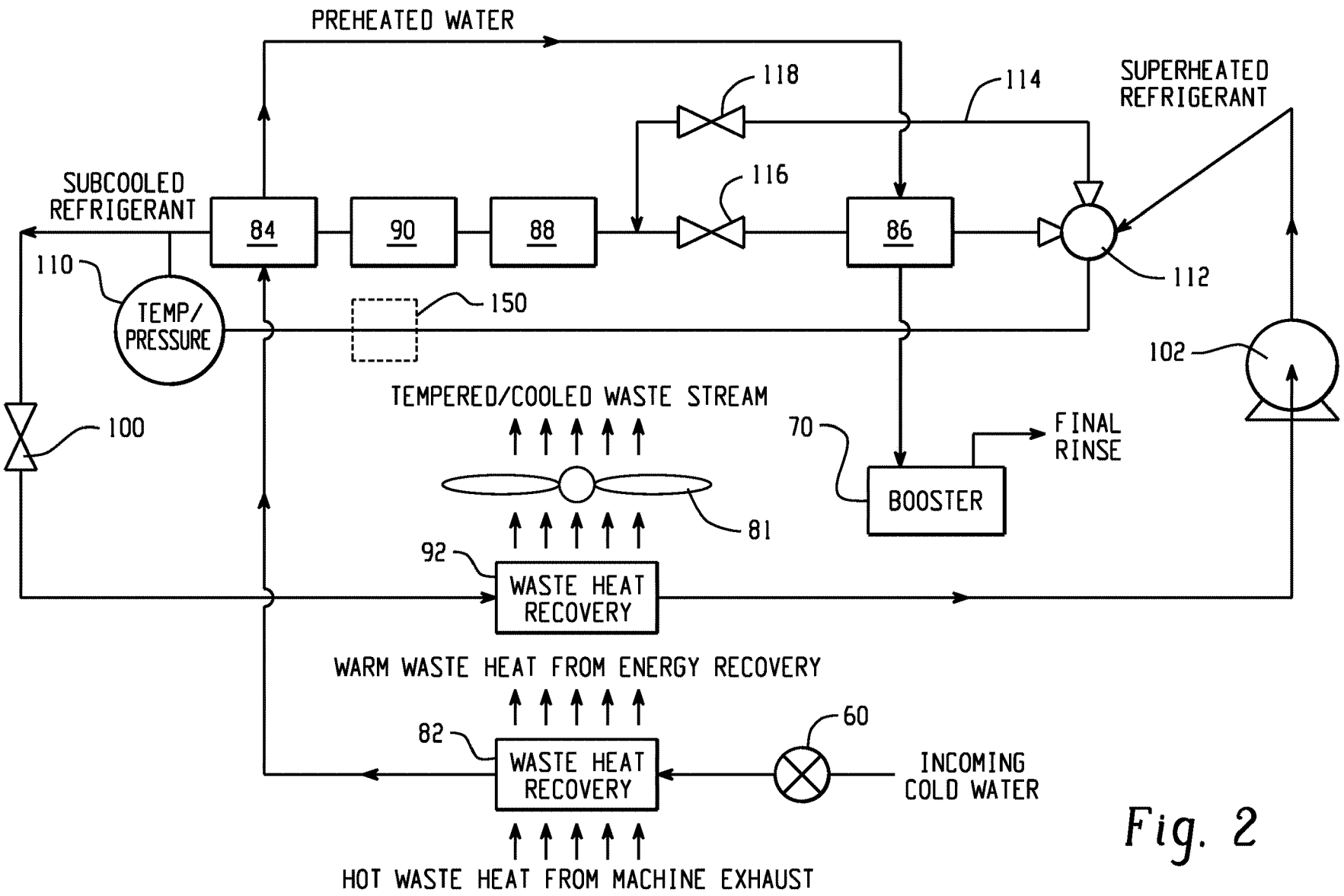
FIG. 2 is a schematic depiction of a refrigerant medium circuit and an incoming water flow path of the warewash machine.

Referring now to FIG. 2, the flow configuration for both incoming fresh cold water and for refrigerant are shown. Cold fresh water is first heated by the hot air passing through the waste heat recovery unit 82, then heated further by refrigerant when passing through condenser 84 and finally heated further by superheated refrigerant when passing through condenser 86. The heated water then enters the booster 70 for final heating. The refrigerant medium circuit 100 includes a thermal expansion valve 101, which leads to a waste heat recovery unit 92 to recover heat from warm waste air (e.g., the exhaust air flow) after some heat has already been removed from the exhaust air flow by unit 82. A compressor 102 compresses the refrigerant to produce superheated refrigerant, which then flows sequentially through the condensers 86, 88, 90 and 84.

Generally, condenser 86 delivers refrigerant heat to the incoming fresh water, condenser 88 may take the form of coil submerged in the wash tank 50 to deliver refrigerant heat to the wash water, condenser 90 may take the form of a coil over which the drying air blows to deliver some refrigerant heat to the drying air and condenser 84, which may be a plate-type heat exchanger, delivers residual refrigerant heat to the incoming fresh water. However, this flow may be altered based upon warewash machine conditions.

In this regard, one or more sensors 110 are provided to monitor the conditions of the subcooled refrigerant. The monitoring may be continuous, periodic or triggered by some event (e.g., identification of a rack at a certain location in the machine). By way of example, both a temperature sensor and a pressure sensor may be used to monitor the subcooled refrigerant medium downstream of the last condenser 84 and upstream of the thermal expansion valve 101. If the monitoring indicates that the condition of the subcooled refrigerant medium has departed from a set specification, then corrective action can be take. For example, if the condition of the subcooled refrigerant medium rises above a desired condition operating range (indicating the refrigerant medium is over-condensed or over sub-cooled) then a two way valve 112 is controlled to cause superheated refrigerant medium to bypass condenser 86 along a bypass path 114 so as to flow directly to condenser 88, causing less heat to be removed from the refrigerant medium on its path to the monitoring location of sensor(s) 110, thus reducing the amount of condensation of the refrigerant medium that takes place. Check valves 116 and 118 are provided respectively on the primary refrigerant path and the bypass path 114. If the condition of the subcooled refrigerant medium remains above the desired condition operating range for a predetermined time period after initiating bypass of the condenser 86, some additional action may be taken, such as activating the wash tank auxiliary heater 58 to heat the wash liquid in order to create a situation where heat can be supplied from the wash liquid to the refrigerant medium, which would help to further reduce the level of condensing and shift the condition of the subcooled refrigerant medium back to the desired operating range. Once the condition falls back down into the desired operating range (e.g., to a mid-point of the operating range) the valve 112 can switched to turn off the bypass and, if applicable, the heater 58 can be turned off.

If the condition of the subcooled refrigerant falls below the desired operating range, then the two way valve 112 is controlled to assure flow the refrigerant medium through the condenser 86 so as to remove more heat from the refrigerant medium on its flow path to the monitoring location of sensor(s) 110, thus increasing the amount of condensation of the refrigerant medium that takes place. If the condition of the subcooled refrigerant medium remains below the desired operating range for a predetermined time period after turning off the bypass, or if the condition of the subcooled refrigerant medium falls and/or remains below the desired operating range when the refrigerant medium is not in bypass, the controller may operate such that the incoming water flow is increased (e.g., where valve 60 enables variable flow control). This increased water flow would cause more heat to be removed from the refrigerant medium, and thus would increase the subcooling of the refrigerant medium, in order to bring the subcooled condition back up into the desired operating range.

By way of example, the subcooled condition may be a difference between the actual temperature indicated by the temperature sensor 110 less a condenser saturation temperature corresponding to the pressure indicated by pressure sensor 110. An exemplary acceptable subcooled condition operating range may be between 10° F. and 15° F., though variations are possible. Above 15° F. indicates the refrigerant medium has been overly condensed, and below 10° F. indicates that the refrigerant medium has not been condensed enough (e.g., gas may be present). The condenser saturation temperature may be determined by reading the pressure indicated by pressure sensor 110 and (i) using a refrigerant pressure/temperature chart or table (e.g., stored in controller memory) to convert the pressure reading to the condenser saturation temperature or (ii) using an equation fitted to a refrigerant medium pressure/temperature chart to convert the pressure reading to the condenser saturation temperature.

In one example valve 112 is configured to switch an entirety of the refrigerant medium flow between the path through condenser 86 and the bypass path. However, valve 112 could alternatively be a proportional valve that is capable of partially splitting the flow between the two paths in variable amounts (e.g., 80/20, 50/50, 20/80 or any desired split). This latter arrangement could provide for more precisely responding to sub cooled refrigerant medium condition.

A controller 150 may be provided to effect switching of the valve 112 based upon indications from the temperature sensor and pressure sensor as described above, as well as for controlling other functions and operations of the machine as discussed above (e.g., controlling the valve 60 and the heater 58). As used herein, the term controller is intended to broadly encompass any circuit (e.g., solid state, application specific integrated circuit (ASIC), an electronic circuit, a combinational logic circuit, a field programmable gate array (FPGA)), processor (e.g., shared, dedicated, or group—including hardware or software that executes code) or other component, or a combination of some or all of the above, that carries out the control functions of the machine or the control functions of any component thereof. The controller may include variable adjustment functionality that enables, for example, the acceptable subcooled condition operating range to be varied (e.g., via an operator interface associated with the controller 150 or via a restricted service/maintenance personnel interface).

Ensuring that the refrigerant medium remains in a desired operating range as indicated above can help system operation by (i) assuring that the refrigerant medium is fully condensed to assist efficient operation of the thermal expansion valve 101, and/or (ii) reducing or eliminating the presence of gas in the refrigerant medium at the upstream side of the thermal expansion valve as the presence of such gas will tend to restrict refrigerant medium flow hence starving the evaporator of refrigerant medium, and/or (ii) assuring that the refrigerant medium is not overcooled coming out of the condenser chain, as such overcooling will require more energy delivery to the refrigerant medium at the evaporator in order to raise the refrigerant medium to desired compressor suction conditions, and if the evaporator is unable to deliver sufficient energy the performance and/or life of the compressor may be adversely impacted.

The above machine provides an advantageous method of controlling refrigerant medium flow in a refrigerant medium circuit of the warewash machine, where the refrigerant medium circuit including at least a first condenser and a second condenser. The method involves: flowing refrigerant medium through both the first condenser and the second condenser; and identifying an out of range condition of subcooled refrigerant medium in the refrigerant medium circuit and thereafter causing refrigerant medium to flow in bypass around at least one of the first condenser or the second condenser.

In one example, the first condenser is arranged to deliver refrigerant medium heat to water being delivered to a booster heater of the machine, and the second condenser is arranged to provide a heat exchange relationship between the refrigerant medium and wash liquid in a wash tank of the machine. Identification of the out of range condition may involve detecting a temperature condition of refrigeration medium between a last condenser in the refrigerant medium circuit and a thermal expansion valve in the refrigerant medium circuit, detecting a pressure condition of refrigerant medium between the last condenser and the thermal expansion valve, and based upon the temperature condition and the pressure condition determining a subcooled condition of the refrigerant medium. In such a case the subcooled condition may be a difference between an actual temperature indicated by the temperature sensor less a condenser saturation temperature corresponding to a pressure indicated by pressure sensor. Regardless, the out of range condition may be indicative of excessive condensing of the refrigerant medium, which triggers the bypass in attempt to reduce the amount of condensing. On the other hand, an out of range condition can also be identified as indicative of insufficient condensing, in which case other steps can be taken (assuring the bypass is not engaged and/or increasing the flow rate of the incoming water) in attempt in increase the amount of condensing.

It is to be clearly understood that the above description is intended by way of illustration and example only and is not intended to be taken by way of limitation, and that changes and modifications are possible. Accordingly, other embodiments are contemplated and modifications and changes could be made without departing from the scope of this application. For example, the term refrigerant commonly refers to known acceptable refrigerants, but other thermal fluids could be used in refrigerant type circuits. The term "refrigerant medium" is intended to encompass all such traditional refrigerants and other thermal fluids. Moreover, while bypass of a first condenser in a four condenser system is primarily described, it is recognized that a lesser number of condensers could be used in some implementations and/or that one or more other or additional condensers could include a similar subcooled condition triggered bypass (e.g., selective bypass of condenser 88).

What is claimed is:

1. A warewash machine for washing wares, comprising:

a chamber for receiving wares, the chamber having at least one wash zone and a conveyor for conveying wares through the wash zone;

a refrigerant medium circuit including a compressor, a first condenser, a second condenser and an expansion device, wherein the first condenser and the second condenser are located downstream of the compressor and upstream of the expansion device in the refrigerant medium circuit, wherein the first condenser is arranged to provide a heat exchange relationship between the refrigerant medium and a first fluid and the second condenser is arranged to provide a heat exchange relationship between the refrigerant medium and a second fluid, the first condenser located upstream of the second condenser in the refrigerant medium circuit;

a bypass arrangement for causing at least some refrigerant medium to selectively bypass at least one of the first heat exchanger or the second heat exchanger based upon subcooled refrigerant medium condition.

2. The machine of claim 1 wherein the bypass arrangement includes a valve upstream of the first condenser, and a bypass path from the valve around the first condenser to a downstream side of the first condenser.

3. The machine of claim 2 wherein the bypass arrangement further includes a refrigerant medium temperature sensor and a refrigerant medium pressure sensor downstream of all condensers in the refrigerant medium circuit and upstream of the expansion device.

4. The machine of claim 3 wherein a controller is connected with the refrigerant medium temperature sensor and the refrigerant medium pressure sensor, the controller configured to determine a subcooled condition of the refrigerant medium and to control the valve based upon the subcooled condition.

5. The machine of claim 4 wherein the controller is configured to switch the valve to flow at least some refrigerant medium along the bypass path when the subcooled condition is above a set operating range.

6. The machine of claim 5 wherein the controller is configured such that, if the subcooled condition remains above the set threshold for a predetermined time period after the valve is switched to flow refrigerant medium along the bypass path, the controller activates a heating element that is positioned to heat the second fluid.

7. The machine of claim 1 wherein the first fluid is incoming water, the first condenser is arranged to deliver refrigerant medium heat to water being delivered to a booster heater of the machine, and the second fluid is a wash liquid in a wash tank of the machine.

8. The machine of claim 7 further comprising:

a third condenser downstream of the second condenser, the third condenser arranged for delivering refrigerant medium heat to drying air of the machine; and a fourth condenser downstream of the third condenser, the fourth condenser arranged to deliver refrigerant medium heat to water being delivered to the booster heater.

9. The machine of claim 7, further comprising:

a first waste heat recovery unit arranged to transfer heat from exhaust air of the machine to water being delivered to the booster heater;

a second waste heat recovery unit arranged as an evaporator in the refrigerant medium circuit to transfer heat from exhaust air of the machine to the refrigerant medium.

10. A warewash machine for washing wares, comprising:

a chamber for receiving wares, the chamber having at least one wash zone;

a refrigerant medium circuit including a compressor, a first condenser, a second condenser and an expansion device, wherein the first condenser and the second condenser are located downstream of the compressor and upstream of the expansion device in the refrigerant medium circuit, the first condenser located upstream of the second condenser in the refrigerant medium circuit, the refrigerant medium circuit including a first flow path through the first condenser and a second flow path in bypass of the first condenser, and a valve for selectively controlling whether at least some refrigerant medium flows along the first flow path or the second flow path based upon subcooled refrigerant medium condition.

11. The machine of claim 10 wherein the first condenser is arranged to deliver refrigerant medium heat to water being delivered to a booster heater of the machine, and the second condenser is arranged to provide a heat exchange relationship between refrigerant medium and wash liquid in a wash tank of the machine.

12. The machine of claim 10 wherein a controller is connected to control the valve, the controller configured to identify subcooled refrigerant medium condition based upon indications from one or more sensors associated with the refrigerant medium circuit.

13. The machine of claim 12 wherein a temperature sensor is located to detect a temperature of refrigerant medium between a last condenser in the refrigerant medium circuit and a thermal expansion valve in the refrigerant medium circuit, and a pressure sensor is located to detect pressure of refrigerant medium between the last condenser and the thermal expansion valve, the controller connected with each of the temperature sensor and the pressure sensor.

14. The machine of claim 13 wherein the controller is configured to identify a predefined subcooled condition indicative of over-condensing of refrigerant medium and to responsively control the valve to flow at least some refrigerant medium along the second flow path upon identification of the predefined subcooled condition.

15. The machine of claim 13 wherein the subcooled refrigerant medium condition is a difference between an actual temperature indicated by the temperature sensor less a condenser saturation temperature corresponding to a pressure indicated by the pressure sensor.

16. A method of adaptively controlling refrigerant medium flow in a refrigerant medium circuit of a warewash machine that includes a chamber for receiving wares, the chamber having at least one wash zone, the refrigerant medium circuit including a compressor, at least a first condenser and a second condenser and an expansion device, at least one of the first condenser or the second condenser in heat exchange relationship with incoming water to the machine, the method comprising:

flowing refrigerant medium through both the first condenser and the second condenser;

if a first out of range condition of subcooled refrigerant medium is identified, causing refrigerant medium to flow in bypass around at least one of the first condenser or the second condenser.

17. The method of claim 16 wherein the first condenser is arranged to deliver refrigerant medium heat to the incoming water being delivered to a booster heater of the machine and the bypass is around the first condenser, and the second condenser is arranged to provide a heat exchange relationship between the refrigerant medium and wash liquid in a wash tank of the machine.

18. The method of claim 17 wherein if the first out of range condition persists for a predetermined time period after the bypass is initiated, a heating element is activated, where the heating element is positioned to heat the wash liquid.

19. The method of claim 16 wherein identification of the first out of range condition involves detecting a temperature condition of refrigeration medium between a last condenser in the refrigerant medium circuit and a thermal expansion valve in the refrigerant medium circuit, detecting a pressure condition of refrigerant medium between the last condenser and the thermal expansion valve, and based upon the temperature condition and the pressure condition determining a subcooled condition of the refrigerant medium.

20. The method of claim 19 wherein the subcooled condition is a difference between an actual temperature indicated by the temperature sensor less a condenser saturation temperature corresponding to a pressure indicated by the pressure sensor.

* * * * *